US005921107A

United States Patent [19]

Yamamoto

[11] Patent Number: 5,921,107

[45] Date of Patent: Jul. 13, 1999

[54] OXYGEN PRODUCTION METHOD RELATED TO A NITROGEN GENERATOR UNIT

[75] Inventor: Takao Yamamoto, Hyogo-ken, Japan

[73] Assignee: Teisan Kabushiki Kaisha, Tokyo, Japan

[21] Appl. No.: 08/754,134

[22] Filed: Nov. 22, 1996

[30] Foreign Application Priority Data

May 14, 1996 [JP] Japan ..... 8-118896

[51] Int. Cl.[6] ..... F25J 3/04

[52] U.S. Cl. ..... 62/643; 62/900

[58] Field of Search ..... 62/643, 900

[56] References Cited

U.S. PATENT DOCUMENTS 3,348,385 10/1967 Kamlani et al. ..... 62/643
4,560,397 12/1985 Cheung ..... 62/643
4,783,210 11/1988 Ayres et al. .

*Primary Examiner*—Christopher B. Kilner
*Attorney, Agent, or Firm*—Young & Thompson

[57] ABSTRACT

A method for producing a small amount of oxygen, related to a nitrogen generator unit, is provided. In a nitrogen rectification column which cools down and liquefies feed air after moisture and carbon dioxide contained therein are removed, thereby producing nitrogen, oxygen-rich liquid air is used as a cold source for a nitrogen condenser and the thus-obtained oxygen-rich air is then used as a heating source for a reboiler in an oxygen rectification column.

10 Claims, 2 Drawing Sheets

OXYGEN PRODUCTION METHOD RELATED TO A NITROGEN GENERATOR UNIT

FIELD OF THE INVENTION

The present invention is suitable for a case where it its required to produce a small amount of oxygen at the same time, without varying the amount of nitrogen produced, in a nitrogen generator unit comprising a rectification column using air as a feed material.

THE KNOWN PRIOR ART

Japanese Patent Application Laid-open (KOKAI) No. 163,797/1979, Japanese Utility Model Application Laid-open (KOKAI) No. 140,990/1980 and Japanese Patent Application Laid-open (KOKAI) No. 15,069/1986 disclose the adoption of a heating gas for a reboiler in the lower part of an oxygen rectification column from a feed air pipe or from the lower part of a nitrogen rectification column.

BACKGROUND OF THE INVENTION

In the aforementioned prior arts, it has been inevitable that the recovery of product nitrogen is decreased several percent to more than ten percent (proportionally to the amount of product oxygen) because nitrogen feed gas rising in a nitrogen rectification column is decreased in amount.

Due to consideration of the aforementioned problems, the present invention is intended to provide a unit which can produce a small amount of oxygen at the same time, without decreasing the amount of nitrogen produced, by solving these drawbacks.

SUMMARY OF THE INVENTION

The oxygen production method related to a nitrogen generator unit, according to the present invention comprises: using, in a nitrogen rectification column which cools down and liquefies feed air to produce nitrogen after moisture and carbon dioxide gas in the feed air are removed therefrom, oxygen-rich liquid air as a cold source for a nitrogen condenser; and then using the resultant oxygen-rich air as a heating source for a reboiler of an oxygen rectification column; and using the thus-condensed, resultant oxygen-rich air as an oxygen feed material and a reflux liquid.

BRIEF DESCRIPTION OF THE DRAWINGS

Other objects, features and advantages of the present invention will become apparent from a consideration of the following description, taken in connection with the accompanying drawings, in which:

In FIG. 1, a flow sheet is shown of one example of the nitrogen generator unit based on the present invention, which can produce a small amount of oxygen at the same time, without decreasing the amount of nitrogen produced.

Figure 1:
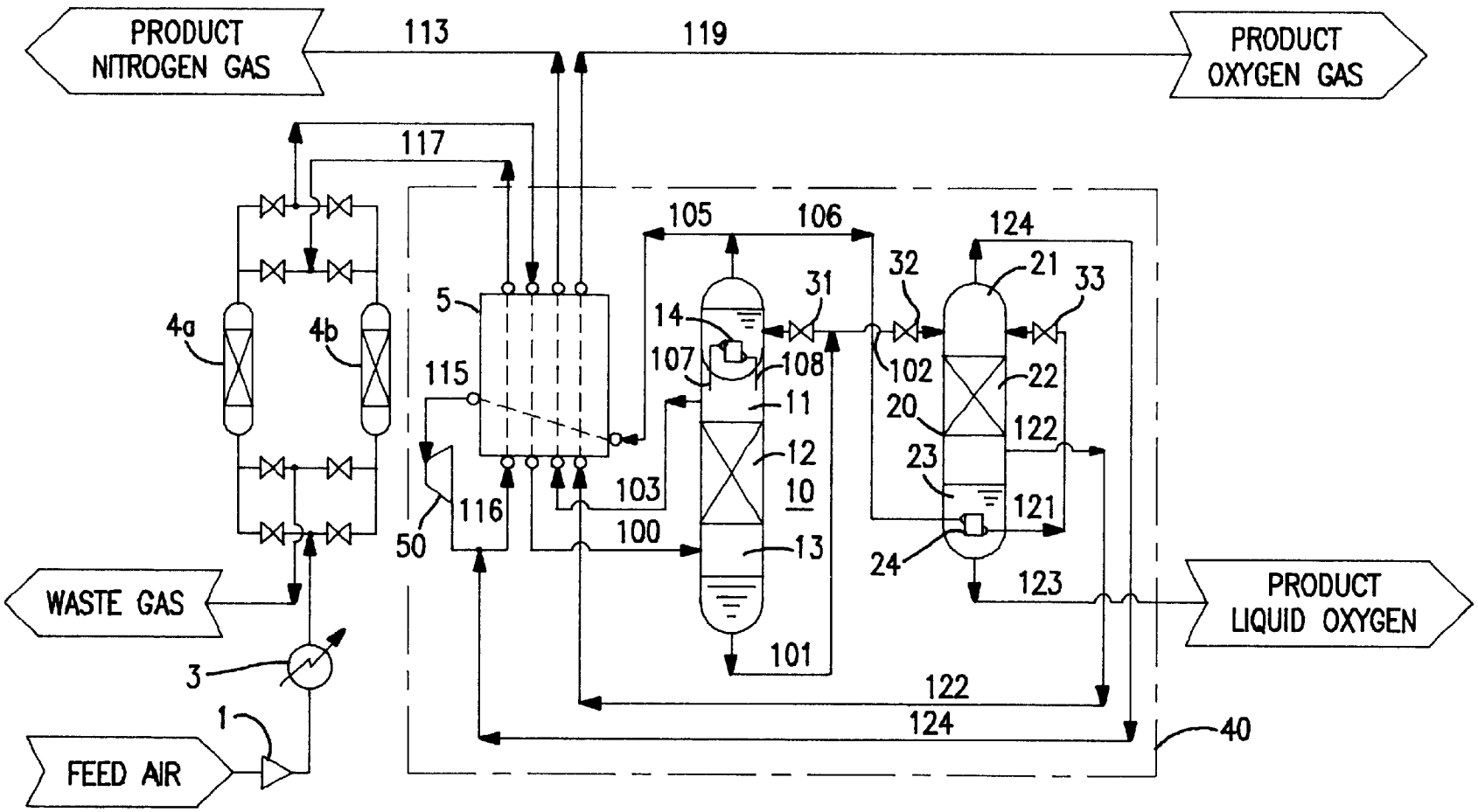
FIG. 1 is a diagram of a first embodiment of apparatus according to the present invention.

In the drawing, the reference numeral 5 represents a main heat exchanger, 10 represents a first rectification column, 11 represents a first upper space part, 12 represents a rectifying part, 13 represents a first lower space part, 14 represents a nitrogen condenser, and 20 represents a second rectification column, 21 represents a second upper space part, 22 represents a rectifying part, 23 represents a second lower space part, 24 represents a reboiler, 31 represents a first expansion valve, 32 represents a second expansion valve, 33 represents a third expansion valve, 40 represents an insulated container, 50 represents an expansion turbine, and further 100 represents a feed air introduction pipe, 101 represents and oxygen-rich liquid air delivery pipe, 102 represents a pipe branched from the pipe 101, 103 represents a product nitrogen gas delivery pipe, 105 represents an oxygen-rich delivery pipe, 106 represents a pipe branched from the pipe 105, 121 represents a delivery pipe for oxygen-rich liquid air liquefied by the reboiler, 122 represents a product oxygen gas delivery pipe, 123 represents a product liquid oxygen delivery pipe, and 124 represents a waste gas delivery pipe, respectively.

A unit for producing nitrogen and a small amount of oxygen will be described here by use of the aforementioned unit.

After feed air is freed of dust by a filter (not shown), it is compressed to a pressure of about 8.4 kg/cm2G by a compressor 1 and cooled down by a refrigerator 3. From the feed air, carbon dioxide and moisture are then removed by as decarbonating/drying unit 4*a* or 4*b*. Thereafter, the feed air is cooled down to a temperature of about 167° C. through an indirect heat exchange with a refrigerant, which will be herinafter described, in the main heat exchanged 5. As a result, a portion of the feed air is fed to below the rectifying part 12 of the first rectification column 10 through the pipe 100, as it is liquefied.

The liquid phase portion of the feed air fed to the first rectification column 10 collects in the bottom portion of the first lower space part 13 and the gas phase portion thereof rises in the first rectification column 10 so as to pass through the rectifying part 12, where it is brought tin a counter-current gas-liquid contact with a reflux liquid consisting of liquid nitrogen flowing down from above. By virtue of this gas-liquid contact, oxygen in the gas phase is dissolved into the reflux liquid, while nitrogen in the reflux liquid is vaporized and released into the gas phase, As a result, nitrogen gas collects in the first upper space part 11 and oxygen-rich liquid air collects in the first lower space part 13.

A portion of the nitrogen gas collected in the first upper space part 11 is delivered by the pipe 103 and introduced into the main heat exchanger 5, where it is exchanged in heat with the feed air so as to get a normal temperature. Thus, this nitrogen gas will be supplied to a user as product nitrogen gas whose pressure is slightly lower than that of the feed air by means of a pipe 113.

The residual portion of the nitrogen gas collected in the first upper space part 11 is introduced into the nitrogen condenser 14 by a pipe 107, where it is cooled down through an indirect hear exchange with oxygen-rich liquid air as a refrigerant, which will be herein after described. The thus-condensed liquid nitrogen is returned to above the rectifying part 12 as the above-mentioned reflux liquid through a pipe 108.

The oxygen-rich liquid air with a temperature of about −167° C., collected in the first lower space part 13, is taken out b the pipe 101, and a portion thereof is introduced into the expansion valve 31, where it is reduced in pressure to a pressure of about 3.2 kg/cm2G so as to become oxygen-rich liquid air as the above-mentioned refrigerant, and this oxygen-rich liquid air is then fed to the nitrogen condenser 14. As to the oven-rich waster gas with a temperature of about 31 175° C., used here, a portion thereof is further introduced in the main heat exchanger 5 by the oxygen-rich waste gas pipe 105, where it is used as a refrigerant to cool down the feed air so as to get a slightly raised temperature. Then, this oxygen-rich waste gas is taken out of the way of the main heat exchanger 5 through a pipe 115 and introduced in the expansion turbine, 50, where it is reduce din pressure to generate cold, and the oxygen-rich waste gas reduced in pressure is taken out of the expansion turbine 50 by a pipe 116 and introduced into the main hear exchanger 5, where it is used again to cool down the feed air. Thereafter, the oxygen-rich waste gas is further used as a gas for regeneration of the decarbonating/drying unit 4*a* or 4*b*, and then discharged out of the system.

The residual portion of the oxygen-rich liquid air taken out by the pipe 101 is introduced in to the second expansion valve 32 by the pipe 102. The oxygen-rich liquid air introduced in the second expansion valve 32 is reduce din pressure to a pressure of about 0.3 kg/cm2G, and partially evaporated so as to become a gas-liquid mixture with a temperature of about −193° C., and this gas-liquid mixture is fed to above the rectifying part 22 of the second rectification column 20. The gas phase portion of said gas-liquid mixture collects in the second upper space part 21, and the liquid phase portion thereof flows down in the rectifying part 22 as a reflux liquid so as to release low boiling point components with its oxygen concentration enhanced, through a counter-current gas-liquid contact with a gas rising from below, and collects in the second lower space part 123. In the second lower space part 23 is installed the reboiler 24. The oxygen-rich waste gas with a temperature of about −175° C., used as a cold source for the nitrogen condenser 14, is introduced into the reboiler 24 as a heating source therefor through the pipe 106 branched from the pipe 105. Thus, it heats a liquid collected in the second lower space 23, whereby components (argon, carbon nonoxide, nitrogen, etc.) having lower boiling points than that of oxygen are selectively evaporated together with oxygen so as to be caused to rise in the rectifying part 22. In addition, the oxygen-rich waste gas used as the heating source in the reboiler 24 is contended and introduced into the expansion valve 33 by the pipe 121, where it is expanded to a pressure of about 0.3 kg/cm2G so as to become a gas-liquid mixture. This gas-liquid mixture is introduced to above the rectifying part 22 of the second rectification column 20 and then it behaves similarly to the gas-liquid mixture introduced therein by said pipe 102.

As a result, nitrogen gas containing components having lower boiling points than that of oxygen collect in the second upper space part 21 and liquid oxygen collects in the second lower space part 23. The nitrogen gas collected in the second upper space part 21 is introduced into the main heat exchanger 5 as a refrigerant from the top part by way of the waste gas pipe 124, after it joins with an oxygen-rich waste gas pipe 116. On the other hand, the oxygen gas collected in the second lower space part 23 is delivered as product oxygen gas by a pipe 122, exchanged in heat in the main heat exchanger 5 so as to get a normal temperature, and then supplied to a user by meanies of a pipe 119, while the liquid oxygen is delivered by a pipe 124 so as to be supplied as produce liquid oxygen to a user.

Figure 2:
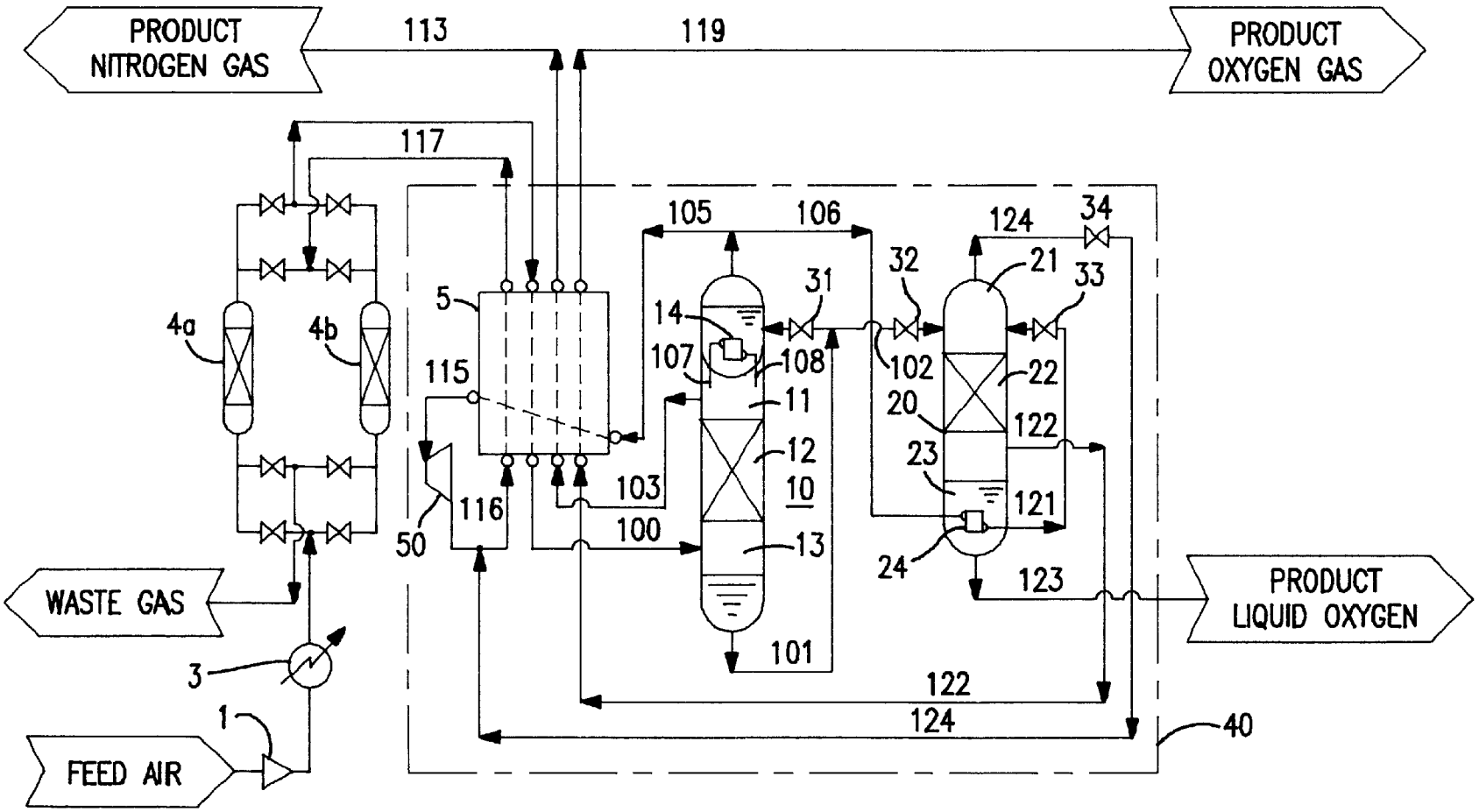
FIG. 2 is similar to FIG. 1 but showing a modification thereof.

In FIG. 2, there is shown a flow sheet of another example of the nitrogen generator unit for producing nitrogen gas and a small amount of oxygen, based on the present invention. In this drawing, the reference numeral 34 represents a fourth expansion valve. Although product oxygen having a little pressure is produced, in FIG. 1, by expanding the pressure of the expansion valves 32, 33 to 0.3 kg/cm2G, the pressure of the product oxygen can be enhanced by regulating the pressure of these valves. At that time, waste gas is reduced in pressure by regulating its pressure, and the pipe 124 is joined with the pipe 116 coming out of the expansion turbine.

In the generator unit of the prior art, heating gas for a reboiler in the lower part of an oxygen rectification column (this is the second rectification column according to the present invention) has been extracted from the lower part of a nitrogen rectification column (this is the first rectification column according to the present invention) or from a feed air pipe. In the is case, feed air which rises in the nitrogen rectification column is decreases in amount. As a result, the recovery of produce nitrogen will be decreased several percent to more than ten percent proportionally to the oxygen amount.

In order to solve this drawback, according to the present invention, a portion of oxygen-rich liquid air is utilized as a cold source of the nitrogen condenser of a nitrogen rectification column, and oxygen-rich air resulting from the evaporation of the oxygen-rich liquid air introduced in the nitrogen condenser as the cold source is further used as a heating gas for the reboiler of an oxygen rectification column. Consequently, the thus-condensed oxygen-rich liquid air is used as a feed liquid and a reflux liquid for the oxygen rectification column, whereby it is enable to produce oxygen, with maintaining the recovery of nitrogen.

I claim:

1. A method of producing oxygen and nitrogen, comprising providing a nitrogen rectification column with a nitrogen condenser and an oxygen rectification column with a reboiler, cooling feed air and supplying said cooled feed air to said nitrogen rectification column, using liquid oxygen-enriched air from said nitrogen rectification column to cool said condenser, thereby vaporizing said liquid oxygen-enriched air to produce vaporized oxygen enriched air, supplying said vaporized oxygen-enriched air to said reboiler, and using another portion of said liquid oxygen-enriched air as reflux in said oxygen rectification column.

2. A method as claimed in claim 1, wherein the sole heating source for said reboiler is said vaporized oxygen-rich air.

3. A method as claimed in claim 1, and sending oxygen-rich air from said reboiler to the top of said oxygen rectification column.

4. A method as claimed in claim 1, wherein oxygen-rich air from said nitrogen rectification column constitutes the only feed to said oxygen rectification column.

5. A method as claimed in claim 1, and removing gas from the top of said oxygen rectification column and using the last-named gas to regenerate adsorbent beds for purification of said feed air.

6. An apparatus for the production of nitrogen and oxygen, comprising a nitrogen rectification column with a nitrogen condenser and an oxygen rectification column with a reboiler, means for cooling feed air and for supplying said cooled feed air to said nitrogen rectification column, means for using liquid oxygen-enriched air from said nitrogen rectification column to cool said condenser and to vaporize said liquid oxygen-enriched air to produce vaporized oxygen-enriched air, means for supplying said vaporized oxygen-enriched air to said reboiler, and means for using another portion of said liquid oxygen-enriched air as reflux in said oxygen rectification column.

7. Apparatus as claimed in claim 6, wherein the sole heating source for said reboiler is said vaporized oxygen-rich air.

8. Apparatus as claimed in claim 6, and means for sending oxygen-rich air from said reboiler to the top of said oxygen rectification column.

9. Apparatus as claimed in claim 6, wherein oxygen-rich air from said nitrogen rectification column constitutes the only feed to said oxygen rectification column.

10. Apparatus as claimed in claim 6, and means for removing gas from the top of said oxygen rectification column and using the last-named gas to regenerate adsorbent beds for purification of said feed air.

* * * * *